US005363597A

United States Patent [19]

Gottschald et al.

[11] Patent Number: 5,363,597

[45] Date of Patent: Nov. 15, 1994

[54] EYELGASS LENS EDGING MACHINE

[75] Inventors: Lutz Gottschald, Meerbusch; Gunter Barwasser, Neuss, both of Germany

[73] Assignee: Wernicke & Co. GmbH, Germany

[21] Appl. No.: 46,155

[22] Filed: Apr. 13, 1993

[30] Foreign Application Priority Data

| | | | |
|---|---|---|---|
| Apr. 14, 1992 | [DE] | Germany | 4212453 |
| Dec. 5, 1992 | [DE] | Germany | 4241016 |
| Feb. 26, 1993 | [DE] | Germany | 4306002 |
| Mar. 19, 1993 | [DE] | Germany | 4308800 |

[51] Int. Cl.[5] ..... B24B 13/00

[52] U.S. Cl. ..... 451/69; 451/240; 451/285; 451/435

[58] Field of Search ..... 51/5 R, 106 LG, 5 B, 51/5 C, 101 LG, 105 LG, 165.71, 165.77, 181 R, 259, 284 R, 284 E; 408/23, 25, 27; 409/165, 199; 29/26 A

[56] References Cited

U.S. PATENT DOCUMENTS

| | | | |
|---|---|---|---|
| 1,145,194 | 7/1915 | Hansen | 51/105 LG |
| 1,740,551 | 12/1929 | Robinson | 51/101 LG |
| 1,886,994 | 11/1932 | Walter | 51/106 LG |
| 2,748,541 | 6/1956 | Connell | 51/284 E |
| 2,991,593 | 7/1961 | Cohen | 51/5 B |
| 3,513,598 | 5/1970 | Asselin et al. | 51/284 E |
| 3,691,898 | 9/1972 | Held | 51/5 B |
| 3,722,143 | 3/1973 | Cottom | 51/284 E |
| 3,750,344 | 8/1973 | Raphael | 51/105 LG |
| 3,769,755 | 11/1973 | Kania et al. | 51/101 LG |
| 4,394,099 | 7/1983 | Santinelli | 51/101 LG |
| 4,616,544 | 10/1986 | Kato | 51/101 LG |
| 4,737,053 | 4/1988 | Paolini | 51/101 LG |
| 4,909,679 | 3/1990 | Berger et al. | 51/101 LG |
| 5,053,971 | 10/1991 | Wood et al. | 51/165.71 |
| 5,148,637 | 9/1992 | Byron | 51/165.71 |

FOREIGN PATENT DOCUMENTS

| | | | |
|---|---|---|---|
| 2942094 | 4/1981 | Germany | 51/284 E |
| 3927412 | 4/1990 | Germany . | |
| 4012660 | 10/1991 | Germany . | |
| 0042049 | 4/1978 | Japan | 51/284 E |
| 60-80550 | 5/1985 | Japan . | |

*Primary Examiner*—M. Rachuba

*Attorney, Agent, or Firm*—Ostrolenk, Faber, Gerb & Soffen

[57] ABSTRACT

Eyeglass lens edging machine with coaxial shaft halves to hold and rotate an eyeglass lens, an edging tool located radially to the eyeglass lens to form a notch or groove at the circumference of the eyeglass lens or to bevel the edge of the eyeglass lens contour and a device for controlled radial and for controlled or unconstrained axial guidance of the edging tool in accordance with the contour of the eyeglass lens and its three dimensional curve.

18 Claims, 3 Drawing Sheets

EYELGASS LENS EDGING MACHINE

BACKGROUND OF THE INVENTION

1. Field of the Invention

The present invention relates to eyeglass lens manufacturing and more particularly to an apparatus for finishing eyeglass lens edges.

2. Related Prior Art

In contrast to the edge of circular eyeglass lenses, the circumference of non-circular eyeglass lenses, which have to be shaped so as to match the eyeglass frame, represents a three-dimensional curve. Every point along the circumference of the non-circular eyeglass lens, this non-circular shape having been imparted by preliminary grinding, exhibits a certain radius from the center point of lens rotation, which differs from the radii of the adjacent points along the circumference. The circumference of the eyeglass lens thus can be defined unequivocally by specifying a radius value and the corresponding angle. Due to the curvature of the eyeglass lens, the grinding point will migrate, i.e. the point of contact between the eyeglass lens and the grinding wheel will wander in a direction parallel to the rotation axis of the eyeglass lens. Providing the circumference of the eyeglass lens is then to be provided with an outwardly projecting ridge or inwardly-projecting groove, it may occur at the transition from sections of the eyeglass lens circumference with longer radii to sections of the eyeglass lens circumference with shorter and from transitions with small curvature that the ridge or the groove runs off course, which will cause difficulties particularly in lenses with positive diopter values having relatively thin edge areas when compared with the center section of the eyeglass lens. These difficulties are particularly serious when the edges of the lens are to have a groove cut, into which a cord is laid for attachment to the eyeglass frame. The grinding wheel diameter being as a rule considerably larger than the diameter of the eyeglass lens aggravates this difficulty, which cannot be eliminated by grinding the groove or ridge in a manner where guidance or control is parallel to the axis of eyeglass lens rotation. This guided or controlled grinding can be effected either purely mechanically or by means of a CNC concept with computer control, whereby the computer also controls the grinding of the circumference in accordance with a pre-determinable eyeglass lens contour. Such CNC controlled eyeglass lens edging machines are known.

In addition, the edges of thick lenses with high negative diopter values, where the ridge is narrower than the edge of the eyeglass lens, become very sharp during the grinding of the circumference, forming a slight bevel is desirable here which, due to the three-dimensional curves described by the forward and rearward faces resulting from the shape of the eyeglass lens, cannot be effected with the normal grinding wheel with its much larger diameter than the eyeglass lens. In addition, there are eyeglass frames in which the eyeglass lenses are held in place by means of claws which engage with notches in the eyeglass lenses. These notches can be cut only on special machines.

A grinding wheel designed to keep the groove from running of course has already been proposed in utility model specification G 88 01 224.7, held by the present applicant, in which the rounded circumference of the grinding wheel, fitted with a grinding ridge, exhibits one or more interruptions. Although an improvement in regard to the groove running off course was achieved with this grinding wheel design, it was nonetheless determined that the groove running of course could not be avoided with certainty for every eyeglass lens.

SUMMARY OF THE INVENTION

The present object of the invention is to devise an eyeglass lens edging machine with which notches or grooves can be cut into the circumference of every type of eyeglass lens and with which the edges can be bevelled, and in which the cutting tool used to create the notch or groove or to bevel the edge follows the three-dimensional curve of the circumference of the eyeglass lens.

Based on this objective, an eyeglass lens edging machine of the type mentioned at the outset is proposed by way of the present invention, fitted with an edging tool to form a notch or groove at the circumference of the eyeglass lens or to bevel the contour of the eyeglass lens, this edging tool is located on a bearing for the driven shaft of a preliminary and final grinding wheel, the axis of which being parallel to two coaxial shaft halves for holding and rotating the eyeglass lens, and which, together with the bearing, can be moved radially and axially in relation to the shaft halves.

The edging tool can be a shaping steel similar to a lathe chisel, with which material can be cut away, especially in the case of plastic lenses. In this case the rotation speed of the shaft halves holding the eyeglass lens is increased in comparison with the speed used when grinding the eyeglass lens edge contour.

The present invention relates to an apparatus in which the notch or groove and/or the bevelling of the edge is not effected with a profiled grinding disk arranged on an axis parallel to that of the eyeglass lens being edged. Instead, an edging tool is provided that is located radially to the eyeglass lens. This edging tool can preferably be a router with rotary drive or a small-diameter grinding tool, with which the notch or the groove can be cut at the circumference of the eyeglass lens. It is also possible to use the same arrangement of the tool axis and a conical grinding tool to bevel the edges. This edging tool is controlled by a suitable device in the radial and axial directions, relative to the eyeglass lens, in order to cut the notch or groove exactly in accordance with the eyeglass lens contour and its three-dimensional curve in a pre-determinable location. Here the movements in the radial and axial directions may be controlled independent one of the other by moving the eyeglass lens in the axial direction only, the edging tool in the radial direction only, or vice versa. When bevelling, use of a device to guide the edging tool in relationship to the eyeglass lens in the radial direction only, while it is kept in contact in the axial direction only by means of a spring pre-load is sufficient.

It is particularly advantageous to use as the eyeglass lens edging machine for forming a notch or groove or for bevelling the, a standard eyeglass edge grinding machine with preliminary and final grinding disks located on an axis parallel to the axis of the shaft halves to grind the eyeglass lens contour and, if indicated, with a groove to grind a ridge. In such an eyeglass lens edging machine it must be possible to control the movement of the shaft halves and grinding disks radially and axially in relationship one to the other, which may be effected either purely mechanically or under computer control with a CNC control concept. In such an eyeglass lens edging machine, the edging tool can be located in a particularly simple fashion at the bearing points for the grinding disks and, thus can be forced to follow the relative motion of the eyeglass lens held between the shaft halves and the grinding disks. The edging tool can be driven by an offset drive in the form of a pair of conical gear wheels or friction wheels, from the grinding disk shaft or from the grinding disk or with a separate drive motor.

The router or grinding tool will preferably be driven at particularly high speeds as is the case, for instance, for dental drills and grinding instruments. The router or a diamond-tipped grinding tool may exhibit here a diameter of about 0.5 mm, length of about 0.7 mm and may be attached to a shaft of considerably larger diameter, between 5 and 10 mm.

To avoid damage when contact is made with the eyeglass lens, the shoulder at the junction between the router or the grinding tool and the shaft may be slightly crowned. The router or diamond-tipped grinding tool can be located at the apex of a conical milling or grinding tool used to bevel the edge of the circumference of the eyeglass lens and both may extend radially beyond the diameter of the grinding wheel.

The bearings for the shaft for the preliminary and final grinding disk may exhibit a cylindrical bearing neck upon which the offset drive is attached with a cylindrical bushing. A shaft with the milling or grinding tool is mounted in the bushing so as to be rotatable and at right angles to the axis of the bearing and is in contact with the shaft to form a power transmission arrangement.

The invention is described in detail below on the basis of several embodiments illustrated. In the drawing:

DESCRIPTION OF THE PREFERRED EMBODIMENT

Figure 1:
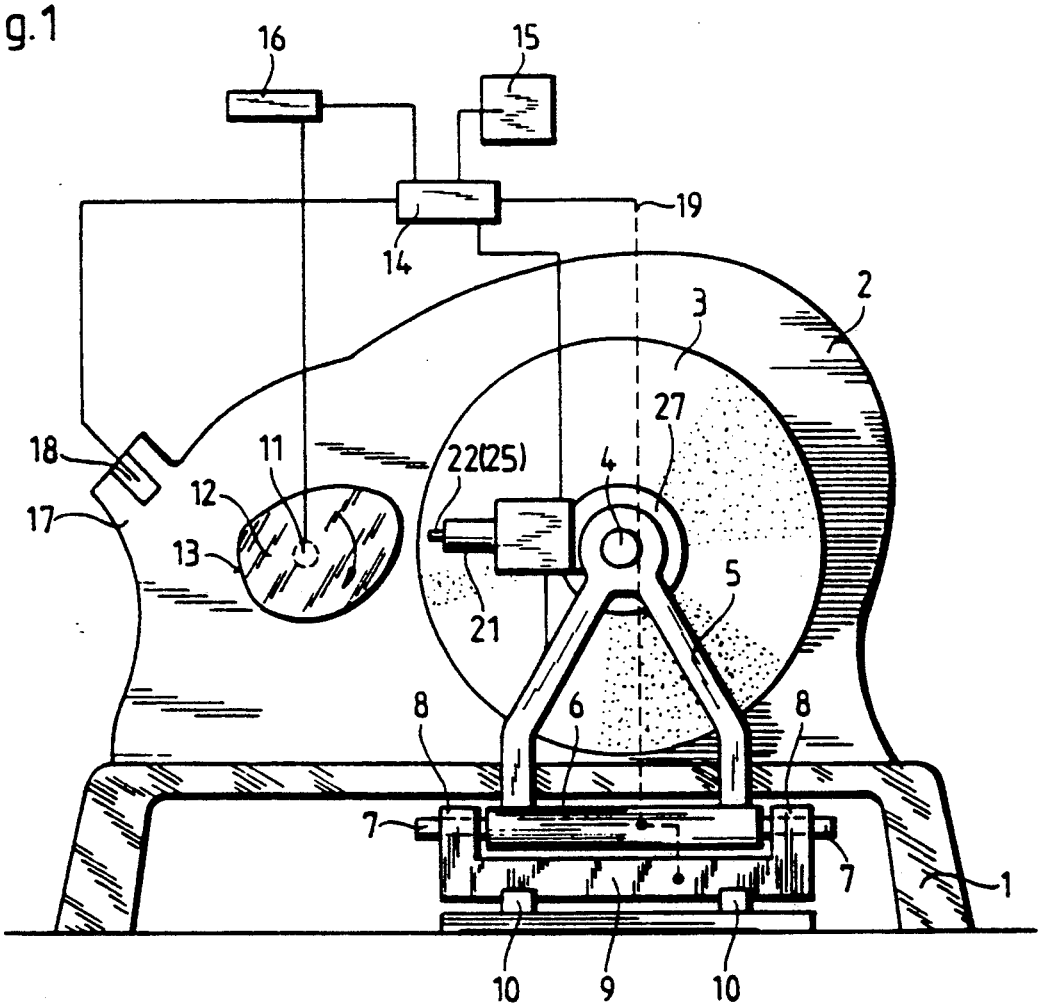
FIG. 1 shows a schematic side view of an eyeglass lens edging machine.
Figure 8:
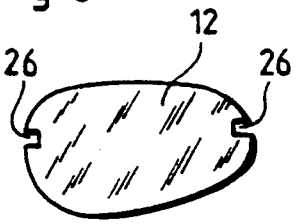
FIG. 8 shows a view of an eyeglass lens exhibiting notches for attachment of an eyeglass frame.

The eyeglass lens edging machine referred to here is a standard, CNC eyeglass lens edge grinding machine with a base 1, a case 2 and located inside the case 2 in a grinding wheel 3, the shaft 4 of which is carried in bearing stands 5 and which is set in rotary motion by a drive motor. The bearing stands 5 rest on a slide 6, which is designed so as to be movable toward an eyeglass lens 12 by means of guide journals 7 resting in bosses 8 on one of the slide rails 9. The slide rail 9 rests on guide rails 10 and can be shifted parallel to the shaft 4.

The eyeglass lens edging machine of the present invention features two coaxial shaft halves 11, between which an eyeglass lens 12 is held by means of an appropriate block of known design. The eyeglass lens contour 13 is formed by the grinding wheel 3 by the shaft halves 11 being set in slow rotation by a drive motor whereby the grinding wheel 3, rotating at high speed, wears away the eyeglass lens contour 13. The eyeglass lens contour is stored in a set-point value memory 15 which is linked with a computer 14. The computer 14 drives, by means of a control cable 19 the drive, not illustrated, for the slider components 6 and 9, which execute the radial and axial motions required at the grinding wheel 3 to generate the desired eyeglass lens contour 13. The rotation of the shaft halves 11 with the eyeglass lens 12 is controlled by a rotation angle transducer 16 while a radius and/or contour transducer 18 located in a recess 17 in the case forward of the computer 14 contains data concerning the eyeglass lens contour 13 which has been machined and/or its three-dimensional curve.

It is also possible to impart the radial and axial movements to the shaft halves 11 carrying the eyeglass lens 12, while the grinding wheel 3 rotates only, or to move the shaft halves 11 with the eyeglass lens 12 radially and the grinding wheel 3 axially, or vice versa.

The shaft 4 extends from a cylindrical bearing neck 20 on the bearing stands 5. Mounted at this bearing neck 20 is a cylindrical bushing 27 which is secured by means of a clamping screw 34. A shaft 21 running in ball bearings 28 in the cylindrical bushing 27 is held in position radial to the axis of the shaft 4. This shaft 21 bears on the one end a conical grinding or milling head 25 and on the other end a friction wheel 30 fitted a rubber ring 29, which engages with a grooved wheel 31 on the shaft 4. The rotation of the shaft 4 causes the conical grinding or milling head 25 to rotate at high speed.

Figure 7:
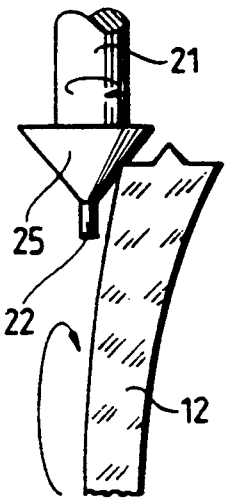
FIG. 7 shows a detail view of an eyeglass lens with the bevelling tool in position.
Figure 9:
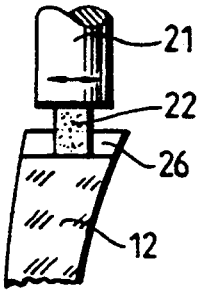
FIG. 9 shows an illustration of the manufacture of a notched eyeglass lens as per FIG. 8.
Figure 2:
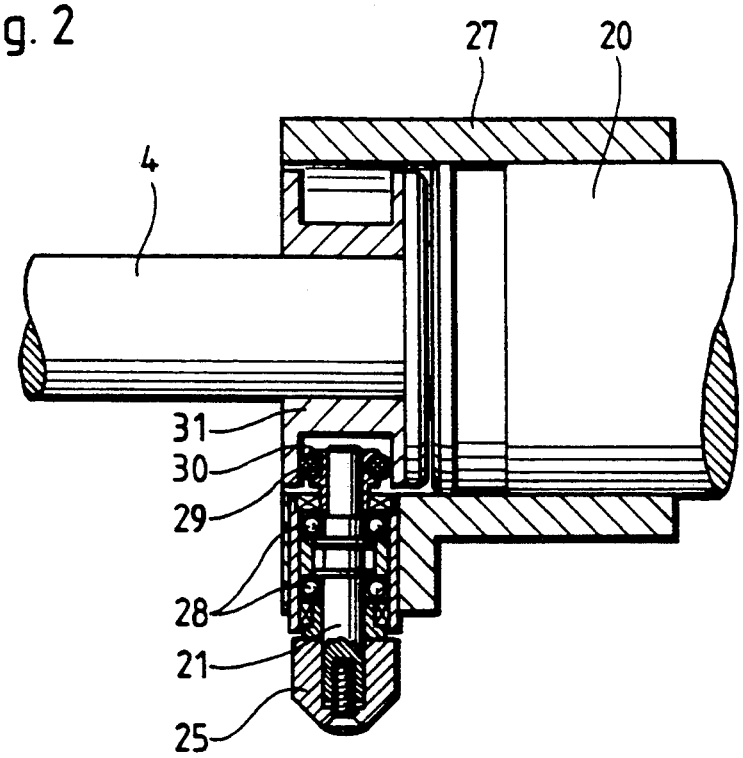
FIG. 2 shows a partial schematic view of an eyeglass lens edging machine with sectional view of the offset drive.
Figure 3:
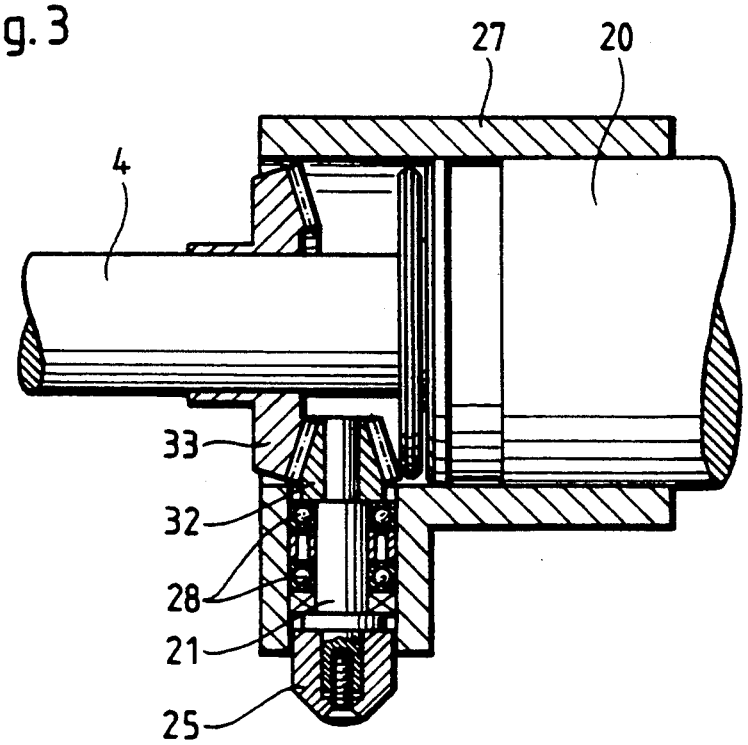
FIG. 3 shows a partial schematic view of an eyeglass lens edging machine with sectional view of another embodiment of the offset drive.
Figure 4:
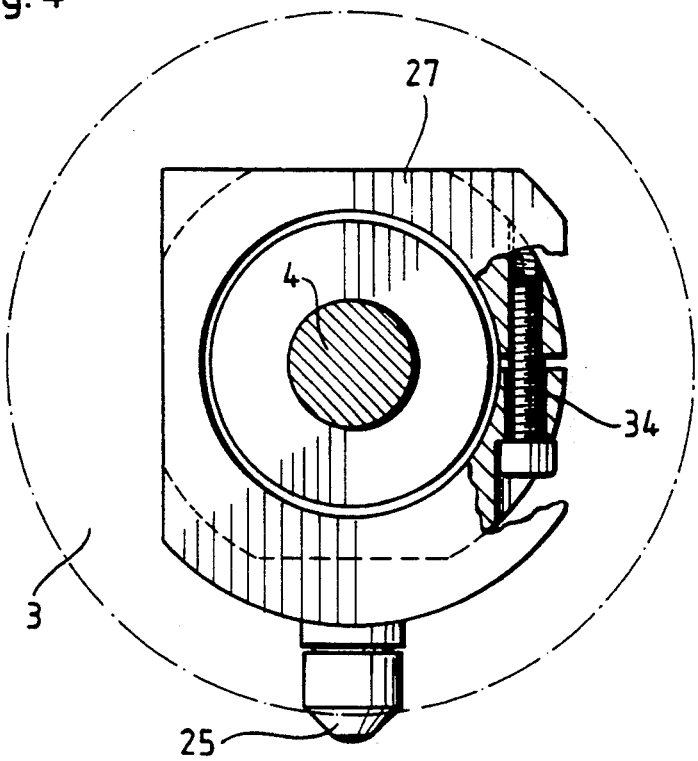
FIG. 4 shows an axial view of the offset drive.
Figure 5:
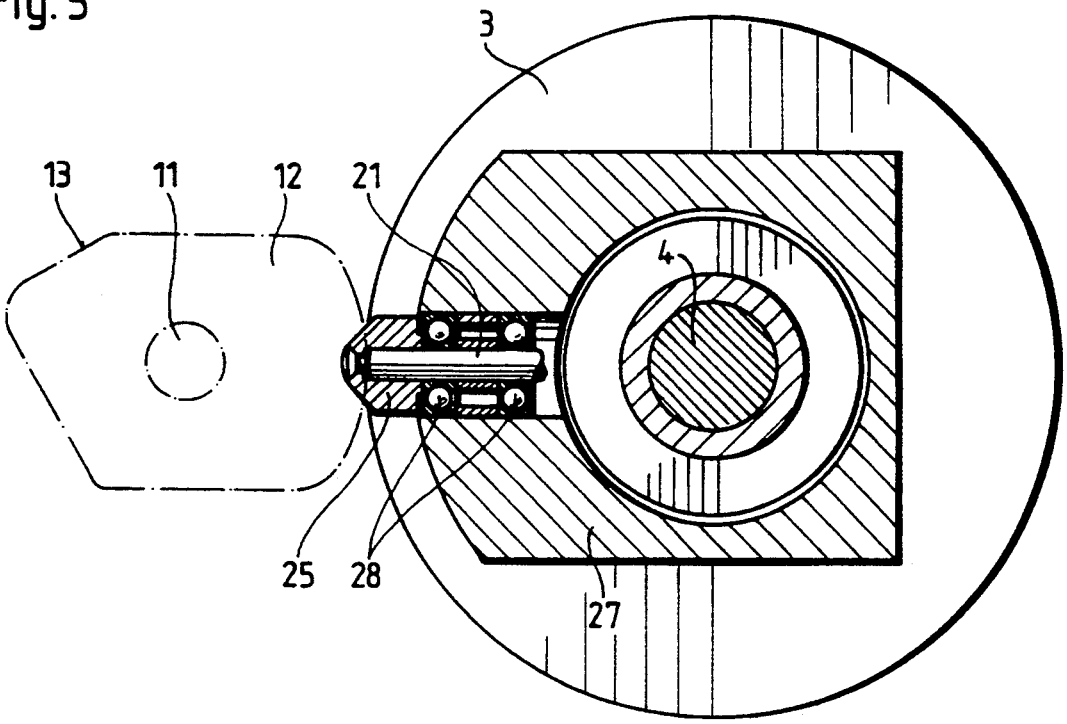
FIG. 5 shows an axial view of the offset drive illustrating the bevelling of an eyeglass lens.

A pair of conical gear wheels 32, 33 can also be used instead of the friction wheel configuration 29, 30 31 to drive the shaft 21, as is illustrated in FIG. 3. The conical grinding or milling head 25 extends by a small amount beyond the diameter of the grinding wheel 3, so that the eyeglass lens 12 can be moved into the vicinity of the conical grinding or milling head 25 for bevelling once the contour has been ground. During bevelling the conical grinding or milling head 25 moves radially to the skid configuration 6, as was already described for the grinding of the eyeglass lens contour 13. To bevel the edges of the eyeglass lens contour 13 the conical grinding or milling head 25 is placed in contact with the edges as illustrated in FIG. 7, but touches these edges only lightly under spring pressure, thereby following the three-dimensional curve of the eyeglass lens contour.

Instead of providing drive motion via the shaft 4 or the grinding wheel 3, a separate high-speed drive motor may be provided for the grinding or milling head 25 without having to modify in any way the arrangement at the bearing neck 20.

Figure 6:
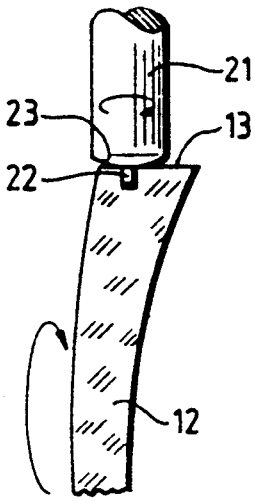
FIG. 6 shows a detail view of an eyeglass lens with the grooving tool in position.

In order to cut a notch or groove at the eyeglass lens contour 13, as illustrated in FIG. 6, it is possible to attach a router 22 or another suitable diamond-tipped tool to the shaft 21 in place of a conical grinding or milling head 25 and to rotate it at high speed by means of the rotation of the shaft 4.

The router 22 or the grinding tool is manufactured in a way similar to a dental drill or grinding instrument and is suitable for forming a notch or groove at the eyeglass lens circumference 13. The router and/or the grinding tool exhibits a diameter of about 0.5 mm and a length of 0.7 mm, corresponding to the normal dimensions of a notch or groove at an eyeglass lens.

In order to form the notch or groove at the circumference of the eyeglass lens once the eyeglass lens contour 13 has been ground with the grinding wheel 3, the router 22 or the grinding tool is set in rotary motion by the shaft 4 and the offset drive 29, 30, 31 or 32, 33, and advanced far enough forward that it moves into the position shown in FIG. 6. This is done so as to penetrate with its length of approx. 0.7 into the eyeglass lens contour 13, until the crowned shoulder 23 between the router 22 or the grinding tool and the shaft 21 comes into in contact with the edge of the eyeglass lens 12. At the same time the eyeglass lens 12 is set in slow rotation by the drive for the shaft halves 11, so that a groove will be ground in the circumference of the eyeglass lens. In so doing the groove describes axially a three-dimensional curve, the motion being imparted to the slide rail 9 as specified by the CNC control via the computer 14. At the same time the computer 14 will control the radial shift of the router 22 or the grinding tool in accordance with the eyeglass lens contour 13, so that a groove of uniform depth is created around the entire circumference or a part of the circumference of the eyeglass lens.

Thus, the control of the movements of the slide components 6 and 9 by means of the computer 14 is used directly to cut the groove in the eyeglass lens contour 13 in accordance with the prescribed eyeglass lens contour and a pre-definable course of the groove along the circumference of the eyeglass lens 12.

Cutting the groove in the circumference of the eyeglass lens 12 can also be effected with an eyeglass lens edging machine without CNC control. For example eyeglass lens 15 may be ground by copy grinding using a template mounted on one of the shaft halves 11, which controls the radial shifting movement of the slide component 6, while the axial movement of the bearing stands 5 with the grinding wheel 3 is effected by shifting the slide rail 9 mechanically by means of a so-called "Panhard rod".

The tip of a conical grinding or milling head 25 used to bevel the edges of a finished eyeglass lens 12 may be fitted with the router 22 or the grinding tool, as is illustrated in FIG. 7.

If an eyeglass lens 12 is to be provided with notches 26 used to attach an eyeglass frame by means of claws, the router 22 or the grinding tool can be used. In this case the eyeglass lens 12 is moved into the angular position corresponding to the location of the notches 26 by means of controlled rotation of the shaft halves 11. Then the router 22 or grinding tool is moved axially into the required position next to the eyeglass lens 12 and then moved axially, parallel to the shaft halves 11, until the notch 26 has been formed. In this case the eyeglass lens 12 need not rotate during processing and the slide component 6 or the edging tool 22 need be moved radially only to adjust the depth of the notch, while the cutting of the notch 6 is effected solely by axial movement of the skid rail 9.

A shaping steel may be used instead of a rotating edging tool 22, 25 if, instead of the drive motor, a suitable mount is located at the bearing stand 5. In this case an axial and radial motion similar to that for the rotating tools is applied to the shaping steel while the shaft halves 11 with the eyeglass lens 12 is set in fast rotary motion so that grooves or bevels are cut with the shaping steel in a fashion similar to that at a CNC controlled or copy lathe. This shaping steel can advantageously be utilized to machine plastic eyeglass lenses.

We claim:

1. Apparatus for machining an edge of an eyeglass lens, comprising:

two coaxial shaft halves for clamping therebetween and rotating said eyeglass lens;

a grinding wheel shaft disposed in parallel with said coaxial shaft halves;

a bearing stand for supporting said grinding wheel shaft;

a grinding wheel, mounted on said grinding wheel shaft, for roughing out and finishing said edge;

an edging tool for making a groove or bevel along said eyeglass lens, said edging tool having a central axis, said edging tool being mounted on said bearing stand such that said central axis is oriented radially to said lens;

means for providing both radial and axial relative movement between said coaxial shaft halves and said bearing stand for bringing said edge into controlled contact with one of said edging tool and said grinding wheel.

2. Eyeglass lens edging machine according to claim 1, wherein said edging tool is a shaping steel.

3. Eyeglass lens edging machine according to claim 1, wherein said edging tool comprises a grinding tool which rotates about an axis of rotation radial to said eyeglass lens.

4. Eyeglass lens edging machine according to claim 3, wherein the rotation of said grinding tool is driven by one of said grinding wheel shaft and said grinding wheel.

5. Eyeglass lens edging machine according to claim 3, wherein said edging tool includes a drive motor for rotating said grinding tool.

6. Eyeglass lens edging machine according to claim 3 wherein said grinding tool and cuts a groove along said eyeglass lens contour.

7. Eyeglass lens edging machine according to claim 6, wherein said grinding tool has a diameter of about 0.5 mm and a length of about 0.7 mm and is mounted on a shaft of said edging tool, said shaft of said edging tool having a diameter of between 5 and 10 mm.

8. Eyeglass lens edging machine according to claim 7, including a shoulder between said grinding tool and said shaft of said edging tool that is slightly crowned.

9. Eyeglass lens edging machine according to claim 3, wherein said grinding tool comprises a conical grinding head and a cylindrical router of small diameter, located at the tip of said conical grinding head.

10. Eyeglass lens edging machine according to claim 3 wherein said grinding tool includes a portion extending radially beyond the diameter of said grinding wheel.

11. Eyeglass lens edging machine according to claim 1, including a device for controlling said radial movement and axial motion between said eyeglass lens and said grinding wheel and said edging tool, and wherein said axial movement is governed by unconstrained spring loading.

12. Eyeglass lens edging machine according to claim 1, wherein said device for controlling comprises a computer for controlling the relative radial motion of said eyeglass lens and said grinding wheel and said edging tool.

13. Eyeglass lens edging machine according to claim 12, including a device for controlled guidance of said relative radial and axial movements of said eyeglass lens and said grinding wheel and said edging tool.

14. Eyeglass lens edging machine according to claim 13, including a computer for controlling the relative radial and axial movements of the between said eyeglass lens and said grinding wheel and said edging tool.

15. Eyeglass lens edging machine according to claim 4, wherein said bearing stand includes a cylindrical bearing neck for receiving a perpendicular gear connection, said bearing neck having a cylindrical bushing, said cylindrical bushing having a holding shaft with said grinding tool perpendicular to an axis of said bearing neck and arranged so as to rotate and be in a power transmission arrangement with said grinding wheel shaft.

16. Eyeglass lens edging machine according to claim 15, wherein said perpendicular gear connection includes a pair of conical gear wheels for driving said holding shaft.

17. Eyeglass lens edging machine according to claim 15, wherein said perpendicular gear connection includes friction wheels connected between said grinding wheel shaft and said holding shaft.

18. Eyeglass lens edging machine according to claim 15, wherein said perpendicular gear connection includes a pair of friction wheels connected between said holding shaft and said grinding wheel shaft.

* * * * *